US006502536B2

(12) United States Patent
Lee et al.

(10) Patent No.: US 6,502,536 B2
(45) **Date of Patent: *Jan. 7, 2003**

(54) METHOD AND APPARATUS FOR TWO-STEP CAM PROFILE SWITCHING

(75) Inventors: Jongmin Lee, Pittsford, NY (US); Hermes A. Fernandez, Rochester, NY (US); Wayne S. Harris, Hilton, NY (US); Ryan D. Fogarty, West Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 41 days.

This patent is subject to a terminal disclaimer.

(21) Appl. No.: 09/813,425

(22) Filed: Mar. 21, 2001

(65) Prior Publication Data

US 2001/0023675 A1 Sep. 27, 2001

Related U.S. Application Data

(63) Continuation-in-part of application No. 09/664,668, filed on Sep. 19, 2000, now Pat. No. 6,325,030.

(60) Provisional application No. 60/176,133, filed on Jan. 14, 2000, and provisional application No. 60/199,716, filed on Apr. 26, 2000.

(51) Int. Cl.[7] ..... F01L 13/00; F01L 1/18

(52) U.S. Cl. ..... 123/90.16; 123/90.41; 123/90.42; 74/559

(58) Field of Search ..... 123/90.15, 90.16, 123/90.17, 90.39, 90.41, 90.42, 90.6; 74/519, 559

(56) References Cited

U.S. PATENT DOCUMENTS

| | | | | | |
|---|---|---|---|---|---|
| 4,768,467 | A | * | 9/1988 | Yamada et al. | 123/90.16 |
| 5,553,584 | A | * | 9/1996 | Konno | 123/90.16 |
| 5,655,488 | A | * | 8/1997 | Hampton et al. | 123/90.16 |
| 5,682,847 | A | * | 11/1997 | Hara | 123/90.16 |
| 5,960,756 | A | * | 10/1999 | Miyachi et al. | 123/90.16 |
| 6,321,705 | B1 | * | 11/2001 | Fernandez et al. | 123/90.16 |
| 6,325,030 | B1 | * | 12/2001 | Spath et al. | 123/90.16 |

* cited by examiner

*Primary Examiner*—Weilun Lo
(74) *Attorney, Agent, or Firm*—Patrick M. Griffin

(57) ABSTRACT

A two-step roller finger follower includes an elongate body having a first side member and a second side member. A first end and a second end interconnect the first and second side members. The first and second side member define first and second pin orifices, respectively. A center roller is disposed between the first and second side members. The center roller defines a shaft orifice therethrough. A shaft extends through the shaft orifice. A first shaft end is disposed proximate the first side member, and the second shaft end is disposed proximate the second side member. The second shaft end defines a shaft bore therein. The first shaft end defines a pin chamber therein. The shaft bore being is substantially concentric with and intersects the pin chamber. A locking pin assembly is disposed partially within the shaft bore, the pin chamber and at least one of the pin orifices. The locking pin assembly has a first position wherein the shaft is decoupled from the body and a second position wherein the shaft is coupled to the body, and is switchable between the first and second positions.

14 Claims, 4 Drawing Sheets

METHOD AND APPARATUS FOR TWO-STEP CAM PROFILE SWITCHING

This application is a continuation-in-part of U.S. patent application Ser. No. 09/664,668, filed Sep. 19, 2000, now U.S. Pat. No. 6,325,030, entitled Roller Finger Follower for Valve Deactivation, which claims the benefit of U.S. Provisional Patent Application Serial No. 60/176,133, filed Jan. 14, 2000, and U.S. Provisional Patent Application Serial No. 60/199,716, filed Apr. 26, 2000.

TECHNICAL FIELD

The present invention relates generally to a method and apparatus for cam profile mode switching. More particularly, the apparatus of the present invention relates to a two-step roller finger follower for cam profile mode switching.

BACKGROUND OF THE INVENTION

Vehicle manufacturers have different goals for various vehicle platforms or models. The primary goal for one particular model may be to provide relatively high fuel economy, and for another model the goal may be to provide relatively high engine power output. The goal of providing relatively high fuel economy can be accomplished through the use of a cam having a relatively low lift and short duration lift profile, whereas high engine power is provided by the use of a cam having a higher lift and longer duration profile. Thus, the goals of high fuel economy and high power often involve conflicting design choices, and an acceptable tradeoff must be reached between the two competing goals for a particular vehicle model.

Generally, high lift long duration output cams are designed to provide high power output at high engine operating speeds. However, such high lift long duration output cams typically result in-decreased engine idle quality and reduced low speed torque and drivability due to reduced air mass charged into the cylinder which is associated with the relatively long overlap duration of the opening and closing of the engine valves. In effect, cams which are designed to increase volumetric efficiency at high engine operating speeds typically reduce volumetric efficiency at lower engine operating speeds. A high lift long duration cam improves volumetric efficiency at high engine. operating speeds by increasing the flow rate past the valve. Additionally, the longer duration lift provides more time in which to fill the cylinder with air. Further, the relatively late closing of the intake valve associated with a long duration cam takes advantage of the inertial effects of the intake charge to further increase high speed volumetric efficiency.

Conversely, a low lift short duration cam is best suited for low engine operating speeds due to improved intake charge-velocity, which improves volumetric efficiency. The increased intake charge velocity also creates a more homogenous mixture that improves combustion by increasing either swirl or tumble. Additionally, the shorter duration cam reduces valve overlap and thereby-improves volumetric efficiency at low engine operating speeds. Further, the relatively early closing of the intake valves associated with such low lift short duration cams further improves volumetric efficiency at low engine operating speeds.

Therefore, what is needed in the art is an apparatus and method that enables selectively activating an engine valve according to, and selectively switching between, a high lift long duration cam and a low lift short duration cam.

Furthermore, what is needed in the art is an apparatus and method that provides a predetermined degree of valve activation for part-load engine operating conditions, and a maximum degree of valve activation for full-load engine operating conditions.

Moreover, what is needed in the art is an apparatus that enables switching between a high lift long duration cam and a low lift short duration cam, and which uses relatively few component parts and occupies approximately the substantially same space as a conventional roller finger follower.

SUMMARY OF THE INVENTION

The present invention provides a method and apparatus for two-step cam profile mode switching.

The invention comprises, in one form thereof, a two-step roller finger follower including an elongate body having a first-side member and a second side member. A first end and a second end interconnect the first and second side members. The first and second side member define first and second pin orifices, respectively. A center roller is disposed between the first and second side members. The center roller defines a shaft orifice therethrough. A shaft extends through the shaft orifice. A first shaft end is disposed proximate the first side member, and the second shaft end is disposed proximate the second side member. The second shaft end defines a shaft bore therein. The first shaft end defines a pin chamber therein. The shaft bore is substantially concentric with and intersects the pin chamber. A locking pin assembly is disposed partially within the shaft bore, the pin chamber and at least one of the pin orifices. The locking pin assembly has a first position wherein the shaft is decoupled from the body and a second position wherein the shaft is coupled to the body, and is switchable between the first and second positions.

An advantage of the present invention is that the two-step roller finger follower for cam profile mode switching enables a high liftlong duration and a low lift/short duration activation of an associated valve while occupying substantially the same amount/volume of space as is occupied by a conventional roller finger follower.

Another advantage of the present invention is that very few component parts are added relative to a conventional roller finger follower.

A further advantage of the present invention is that the two-step roller finger follower for cam profile mode switching improves engine idle quality and driveability during part-load engine operating conditions by enabling a low lift/short duration activation of an associated valve, and improves volumetric efficiency and power at high engine operating speeds.

A still further advantage of the present invention is that the two-step roller finger follower for cam profile mode switching employs roller bearings for reduced friction and increased fuel economy for both high-lift and low-lift motion.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Generally, and as will be described more particularly hereinafter, the two-step roller finger follower for cam profile mode switching (two-step RFF) of the present invention is switchable between a first mode and a second mode. In the first mode, the two-step RFF transfers rotary motion of at least one outer, such as, for example, a low lift and short duration, cam lobe of a camshaft of an internal combustion engine to pivotal movement of the body of the two-step RFF to thereby actuate an associated valve of the engine in accordance with the lift profile of the at least one outer cam lobe. In the second mode, the two-step RFF transfers rotary motion of a center, such as, for example, a high-lift and long duration, cam lobe of the camshaft to pivotal movement of the two-step RFF body to thereby actuate an associated valve in accordance with the lift profile of the center cam lobe.

Figure 1:
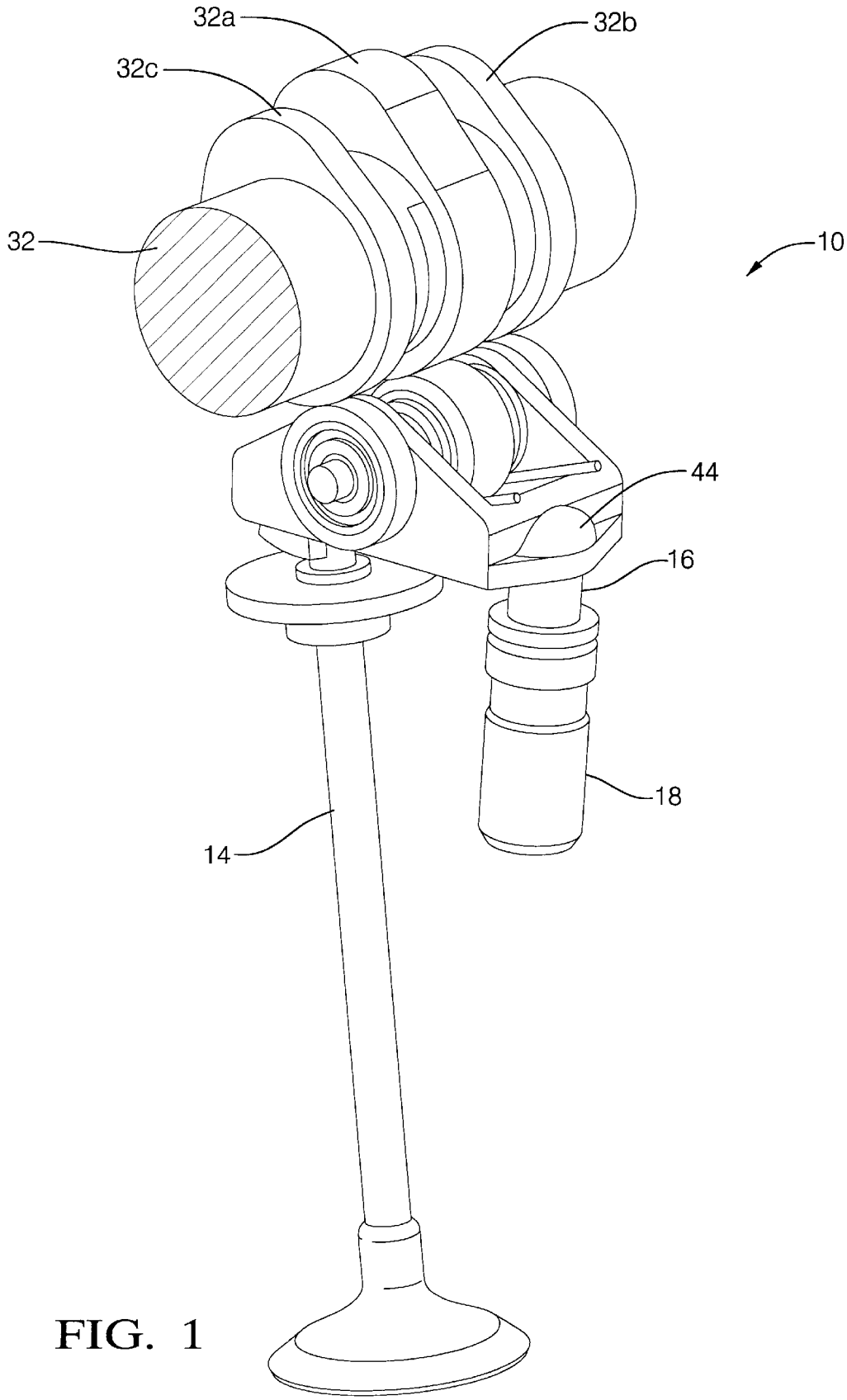
FIG. 1 is a perspective view of one embodiment of a two-step roller finger follower for cam profile mode switching of the present invention, as installed in an internal combustion engine.
Figure 2:
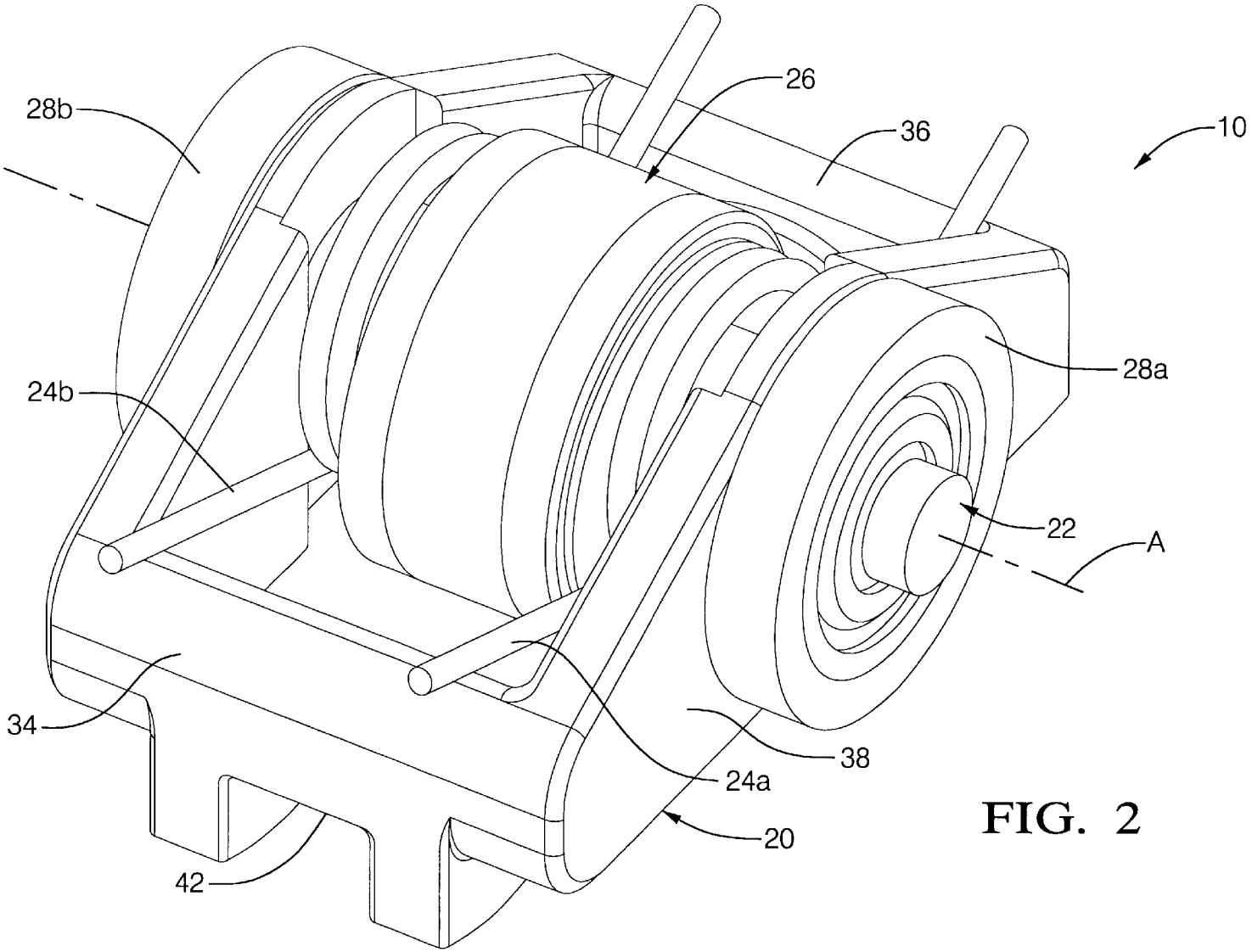
FIG. 2 is a perspective view of the two-step roller finger follower for cam profile mode switching of FIG. 1.
Figure 3:
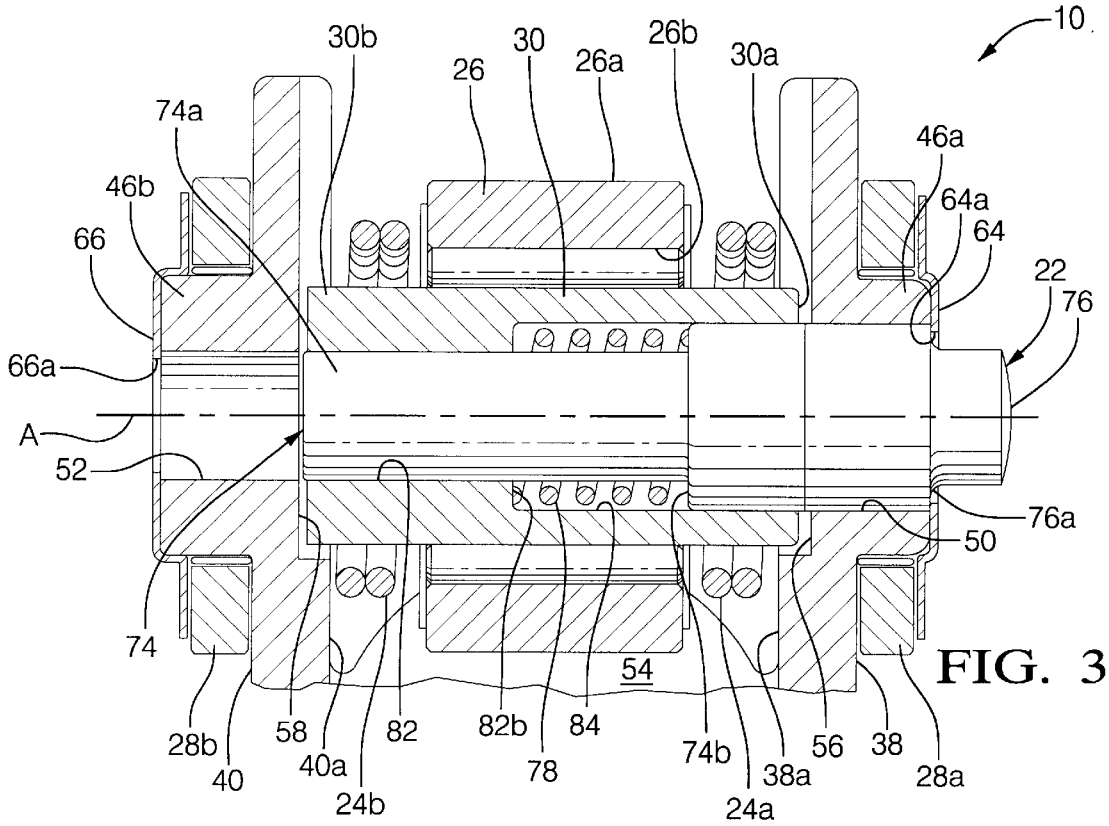
FIG. 3 is a partially fragmentary cross-sectional view of the two-step roller finger follower for cam profile mode switching of FIG. 1 with the locking pin assembly in the default, decoupled, or first mode position.

Referring now to the drawings and particularly to FIGS. 1–3, there is shown one embodiment of a two-step RFF 10 of the present invention. Two-step RFF 10 is installed in internal combustion engine 12, and engages camshaft 32 of engine 12. One end of two-step RFF 10-engages valve 14 of engine 12, the other end engages a stem 16 of lash adjuster 18. Referring now specifically to FIGS. 2 and 3, two-step RFF 10 includes body 20, locking pin assembly 22, lost motion springs 24*a* and 24*b*, central roller 26, bearings 28*b*, 28*b*, and hollow shaft 30 (FIG. 3).

Body 20 includes first end 34, second end 36, elongate first side-member 38, and elongate second side member 40. First end 34 includes valve stem pallet 42, which receives valve 14 of engine 12. Second end 36 defines a hemispherical lash adjuster socket 44 (see FIG. 1), which receives lash adjuster stem 16 of engine 12. Each of first side member 38 and second side member 40 extend between and interconnect first end 34 and second end 36. Each of first side member 38 and second side member 40 include a respective bearing boss 46*a*, 46*b* (FIG. 3) which support a corresponding one of bearings 28*b*, 28*b*. Body 20 is constructed of, for example, steel, carbon steel, or alloy steel.

As best shown in FIG. 3, each of first side member 38 and second side member 40 define a respective pin orifice 50, 52 therethrough. Each of pin orifices 50, 52 is concentric with center axis A. First side member 38 and second side member 40 each include an inside surface 38*a*, 40*a*, respectively. Roller aperture 54 is defined between inside surfaces 38*a*, 40*a*, and intermediate first end 34 and second end 36. Inside surface 38*a* defines slot 56 which is disposed adjacent roller aperture 54. Inside surface 40*a* defines slot 58, which is disposed adjacent roller aperture 54 and is transversely opposite slot 56. Each of slots 56, 58 extend from a respective top surface (not referenced) a to a corresponding, bottom surface (not referenced) of first and second side members 38, 40.

As stated above, first side member 38 includes bearing boss 46*a*. Boss 46*a* surrounds pin orifice 50. Retaining clip 64 defines retaining clip orifice 64*a*, and is secured, such as, for example, by rolling, to boss 46*a* such that retaining clip orifice 64*a* is substantially concentric with pin orifice 50. Similarly, second side member 40 includes bearing boss 46*b* which surrounds pin orifice 52. Retaining clip 66 defines retaining clip orifice 66*a*, and is secured, such as, for example, by rolling, to boss 46*b* such that retaining clip orifice 66*a* is substantially concentric with pin orifice 52.

Figure 4:
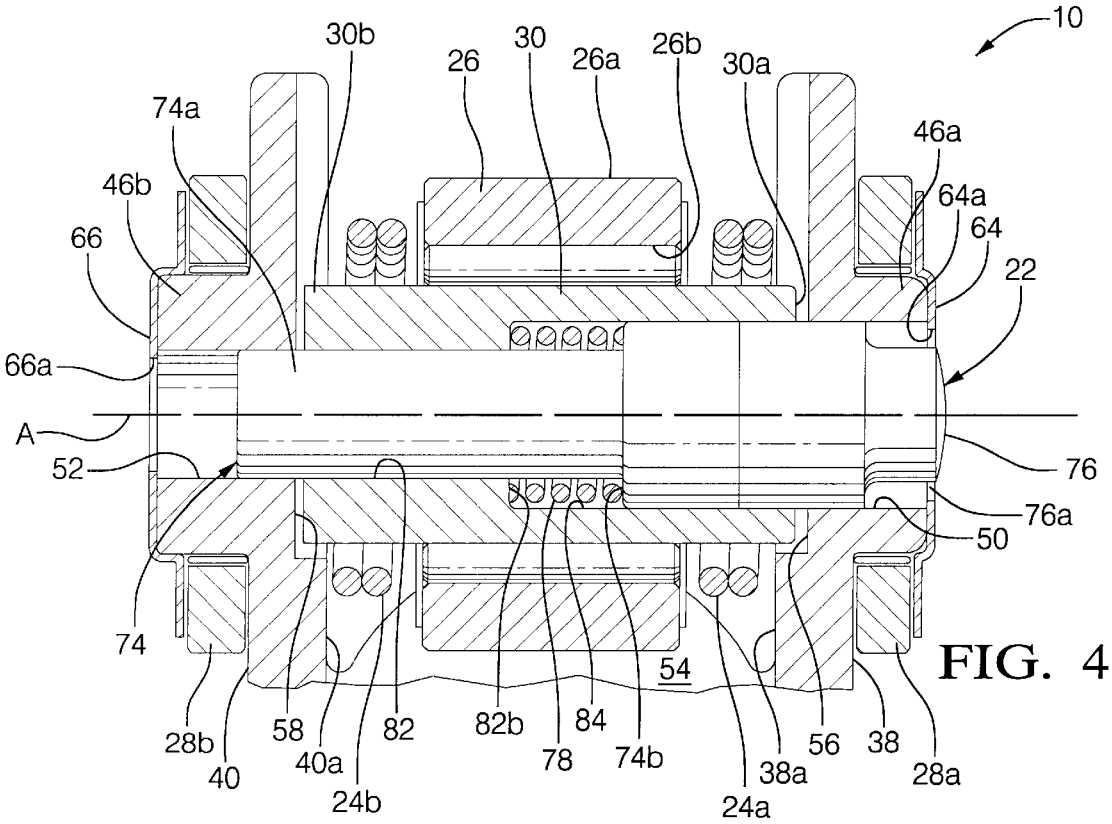
FIG. 4 is a partially fragmentary cross-sectional view of the two-step roller finger follower for cam profile mode switching of FIG. 1 with the locking pin assembly in the coupled or second mode position.

Locking pin assembly 22, as best shown in FIGS. 3 and 4, includes locking pin 74, button 76, and pin spring 78. Locking pin 74 includes stem portion 74*a* and head 74*b*. Locking pin 74 is slidably disposed at least partially within shaft 30, as will be described more particularly hereinafter. Button 76 is a substantially cylindrical member having shoulder 76*a*. Button 76 is slidably disposed at least partially within pin orifice 50 in first side member 38 and is selectively received within shaft 30. Pin spring 78 is disposed within shaft 30 in association with locking pin 74, and biases locking pin assembly 22 into the first, such as, for example, low-lift, mode. Each of locking pin 74 and button 76 are constructed of, for example, steel, carbon steel, or alloy steel. Pin spring 78 is constructed of, for example, music or piano wire, and configured as, for example, a coil spring. As will be more particularly described hereinafter, locking pin assembly 22 is operable to switch two-step RFF 10 between the first mode and the second mode.

Lost motion springs 24*a* and 24*b* are coiled around opposite ends of shaft 30. More particularly, lost motion spring 24*a* is coiled around the end of shaft 30 proximate second side member 38 and lost motion spring 24*b* is coiled around the other end of shaft 30 proximate first side member 40. Each of lost motion springs 24*a* and 24*b* extend radially from shaft 30 to abuttingly engage each of first end 34 and second end 36 of body 12. Each of lost motion springs 24*a* and 24*b* apply a spring force or load upon hollow shaft 30 to thereby bias hollow shaft 30 in the direction of the top surfaces (not referenced) of body 12, i.e., in a direction toward cam shaft 32 (FIG. 1). Lost motion springs 24*a* and 24*b* are configured as, for example, torsion springs, and are constructed of, for example, chrome silicon.

Central roller 26 is a substantially cylindrical hollow member which includes outside surface 26*a* and central bore or orifice 26*b*. Elongate hollow shaft 30 extends through central orifice 26*b*, with the ends thereof disposed adjacent a corresponding one of first side member 38 and second side member 40. A plurality of needle bearings 80 are disposed intermediate central orifice 26*b* of roller 26 and hollow shaft 30. Thus, roller 26 is free to rotate about hollow shaft 30 in an essentially friction free manner. Outside surface 26*a* of roller 26 is configured to engage central, such as, for example, high-lift, cam lobe 32*a* (FIGS. 1 and 5) of camshaft 32. Roller 26 is constructed of, for example, steel, carbon steel, or alloy steel.

Shaft 30 is an elongate substantially cylindrical hollow member extending transversely between first side member 38 and second side member 40. Shaft 30 has first end 30*a* disposed in slot 56 and second end 30*b* disposed within slot 58. Shaft 30 has a predetermined diameter to enable it to freely reciprocate within each of slots 56, 58 in a generally vertical direction while preventing any binding and minimizing movement of shaft 30 toward and away from either of first end 34 and second end 36. Shaft 30 defines shaft bore 82 and pin chamber 84. Each of shaft bore 82 and pin chamber 84 are substantially concentric relative to central axis A. Shaft bore 82 and pin chamber 84 are contiguous with and intersect each other at shoulder 82*b*. Stem portion 74*a* of locking pin 74 is slidably disposed at least partially within shaft bore 82 and pin chamber 84, and is selectively received within pin orifice 52. Pin spring 78 is disposed in abutting engagement with each of head 74*b* of locking pin 74 and shoulder 82*b* of shaft bore 82. Pin spring 78 pre-loads or biases locking pin assembly 22 toward an unlocked position to thereby place two-step RFF 10 into a first, or low-lift, mode. Button 76 is slidingly disposed at least partially within first pin orifice 50 and is selectively received within pin. chamber 84. Shaft 28 is constructed of, for example, steel, carbon steel, or alloy steel.

As described above, locking pin assembly 22 is operable to switch two-step RFF 10 between the first mode and the second mode. Locking pin assembly 22 is now described in the first, or low-lift, mode as shown in and with reference to FIG. 3. In the first mode, locking pin assembly 22 decouples shaft 30 from body 20. In this first or decoupled mode, button 76 is disposed only within pin orifice 50 of first side member 36. A portion of button 76 extends from pin orifice 50 on the side of first side member 38 that is opposite inside surface 38*a* thereof. Similarly, locking pin 74 is disposed only within shaft bore 82 and pin chamber 84 of shaft 30. No portion of locking pin 74 is disposed within pin orifice 52 and no portion of button 76 is disposed within pin chamber 84 when locking pin assembly 22 is in-the first or low-lift mode. Thus, shaft 30 is not coupled to either of first side member 38 or second side member 40 of body 20. Therefore, as rotary motion of center cam lobe 32*a* is transferred by roller 26 to shaft 28, shaft 28 is correspondingly displaced relative to body 20. More particularly, rotary motion of center cam lobe 32*a* is transferred via roller 26 to reciprocation of shaft 30 within each of slots 56 and 58 in a direction toward and away from camshaft 32. In contrast to the first or high-lift mode, rotary motion of center cam lobe 32*a* is not transferred by shaft 28 to pivotal movement of body 20, and. therefore valve 14 is not actuated in accordance with the lift profile of center cam lobe 32*a*. Rather, body 20 is pivoted and valve 14 is actuated according to the lift profile of outside cam lobes 32*b*, 32*c*, which engage bearings 28*b*, 28*b*, respectively.

In the second, or high-lift, mode, as shown in FIG. 4, locking pin assembly 22 couples shaft 30 to body 20 to thereby transfer rotary motion of center cam lobe 32*a* (FIGS. 1 and 5) to vertical motion of valve 14 (FIG. 1). In this second or coupled mode, stem portion 74*a* of locking pin 74 is disposed within each of pin orifice 52 in second side member 40, shaft bore 82 and pin chamber 84, thereby coupling shaft 30 to second side member 40. Button 76, in the second mode, is disposed within each of pin chamber 84 and pin orifice 50 of first side member 38. Thus, button 76 couples shaft 30 to first side member 38. With locking pin assembly 22 in the second mode, as described above, shaft 30 is coupled to each of first side member 38 and second side member 40, and thus rotary motion of center cam lobe 32*a* is transferred by roller 26 to shaft 30. The coupling of shaft 30 to each of first and second side members 38, 40, respectively, by locking pin assembly 22 transfers the rotary motion of center cam lobe 32*a* to pivotal movement of body 20 about lash adjuster 18. Thus, valve 14 is actuated in accordance with the lift profile, such as, for example, a high and long duration lift profile, of center cam lobe 32*a*.

Figure 5:
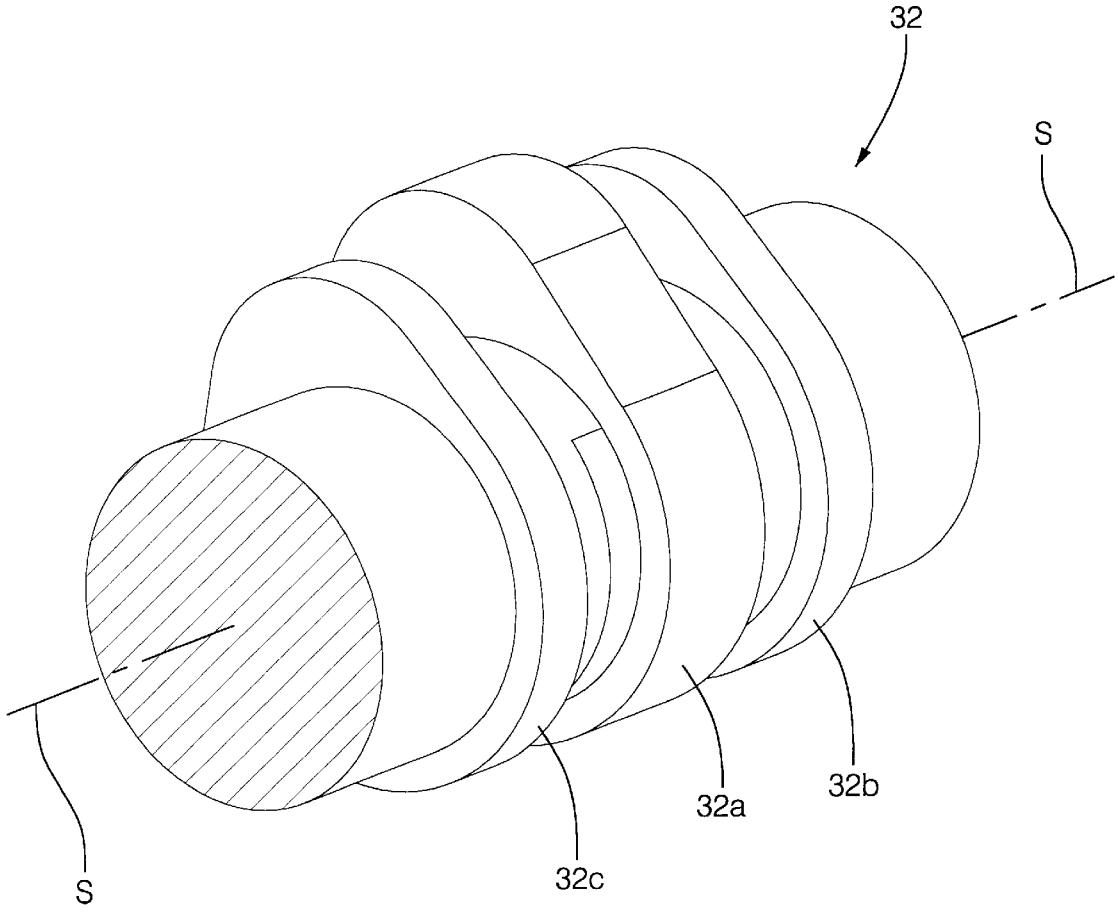
FIG. 5 is a perspective, fragmentary view of one embodiment of the camshaft of FIG. 1.

As best shown in FIG. 5, camshaft 32 has central axis S and includes center cam lobe 32*a*. Center cam lobe 32*a* is configured, such as, for example, a high-lift cam lobe. Disposed on each side of and adjacent to center cam lobe 32*a* are outside cam lobes 32*b*, 32*c*, which are configured as, for example, low-lift cam lobes relative to center cam lobe 32*a*. Outside cam lobes 32*b*, 32*c* and center cam lobe 32*a* are disposed in a predetermined angular relation relative to each other, and relative to central axis S of camshaft 32. Outside cam lobes 32*b*, 32*c* have a lift profile which is less in magnitude and duration than the lift profile of center cam lobe 32*a*.

In use, two-step RFF 10 is disposed such that outer surface 26*a* of roller 26 engages center cam lobe 32*a*, valve stem pallet 42 receives the end of a valve stem (not referenced) of valve 14, and lash adjuster socket 44 engages lash adjuster stem 16. With two-step RFF 10 in the first, or low lift, mode (FIG. 3), locking pin assembly 22 decouples shaft 30 from body 20. Bearings 28*a*, 28*b* engage outside lobes 32*b*, 32*c* of camshaft 32, which pivot body 20 and thereby actuate valve 14 according to the lift profile of outside lobes 32*b*, 32*c*. Locking pin assembly 22, and thus two-step RFF 10, is selectively placed into and switched between the first and second modes by a control device (not shown), such as, for example, a hydraulic actuating piston (not shown) which is mounted into a bore on the cam bearing tower (not shown) adjacent two-step RFF 10. The actuating piston is in axial alignment with button 76 of locking pin assembly 22. Pressurized fluid, such as, for example, oil, is selectively fed into and removed from the bore of the actuating piston to, thereby cause the actuating piston to translate outward or retract inward in a direction toward and away from button 76.

Locking pin assembly 22, and thus two-step RFF 10, is placed into the second/high-lift mode (FIG. 4), wherein shaft 30 is coupled to body 20, by translating the actuating piston outward and into engagement with button 76. The actuating piston overcomes the force of pin spring 78 and slidingly displaces button 76 axially in a direction toward second side member 40. The actuating piston displaces at least a portion of button 76 from within pin orifice 50 and into pin chamber 84 of shaft 30. The displacement of button 76 into pin chamber 84 results in a corresponding displacement of stem portion 74*a* of locking pin 74 out of shaft bore 82 and into pin orifice 52 of second side member 40. Thus, shaft 30 is coupled to each of first side member 38 and second side member 40. The actuating piston axially displaces button 76 into pin orifice 50*a* predetermined distance in a direction toward second side member 40.

With locking pin assembly 22, and thus two-step RFF 10 in the second/high-lift mode, outside cam lobes 32*a*, 32*b* have substantially no operable effect upon the operation of valve 14; However, with locking pin assembly and RFF 10 in the first/lowlift mode (FIG. 3), outside cam lobes 32*a*, 32*b*, operate to open or lift valve 14 a predetermined small amount and duration. The slight activation of valve 14 allows a relatively small amount of air to enter the associated cylinder of engine 12, thereby ensuring a higher intake velocity, a more complete combustion process, and thereby improve driveability under low load conditions and engine.idle quality.

Locking pin assembly 22, and thus two-step RFF 10, is placed into the first/low-lift mode by retracting the actuating piston inward thereby disengaging the actuating piston from contact with button 76. As stated above, pin spring 78 is disposed, or compressed, between shoulder 82*b* of shaft bore 82 and head 74*b* of locking pin 74. Pin spring 78 exerts an axially directed force against head 74*b* to thereby pre-load or normally bias locking pin assembly 22 into the first/low-lift mode. Pin spring 78 slidingly displaces locking pin 74 axially in the direction of first side member 38 and into abutting engagement with button 76. The displacement of locking pin 74 results in a corresponding displacement of button 76 in the same direction. Button 76 is thus displaced until shoulder 76*a* of button 76 contacts retaining clip 64. The engagement of shoulder 76*a* by retaining clip 64 limits the axial displacement of button 76 by pin spring 78, and thereby establishes the first/low-lift mode positions of locking pin 74 and button 76 relative to body 20.

In the first/low-lift mode, the interface of locking pin 74 and button 76 is disposed within slot 56 of first side member 38. This axial position permits locking pin 74 to move relative to or slide over button 76 within slot 56 in a direction toward and away from camshaft 32. Similarly, in the first/low-lift mode, the end of locking pin 74 proximate second side member 40 is disposed within slot 58 of second side member 40. This axial position permits locking pin 74 to move or slide within slot 58 in a direction toward and away from camshaft 32. Thus, shaft 30 is likewise enabled to move or slide within each of slots 56, 58 in a direction toward. and away from camshaft 32.

In the first/low-lift mode, lost motion springs 24*a* and 24*b* absorb the motion of shaft 30 as roller 26 engages and follows the lift profile of center cam lobe 32*a*, and ensure that roller 26 remains in contact therewith. Slots 56, 58 retain and guide the movement of shaft 30 as center cam lobe 32*a* rotates and displaces shaft 30. As stated above, lost motion springs 24*a* and 24*b* are coiled around respective ends of shaft 30 proximate to second side member 40. and first side member 38, respectively. Lost motion springs 24*a* and 24*b* apply a spring force or load upon shaft 30 to thereby bias shaft 30 in the direction of camshaft 32. As center cam lobe 32*a* is rotated onto the nose thereof, a downward force is exerted upon shaft 30. The force of lost motion springs 24*a* and 24*b* upon shaft 28 is overcome by the force exerted by center cam lobe 32*a* through roller 26 upon shaft 30, thereby: resulting in shaft 30 being slidingly displaced downward within slots 56, 58 in a direction away from camshaft 32. The downward motion of shaft 30 is absorbed by lost motion springs 24*a* and 24*b*. As center cam lobe 32*a* is rotated onto the base circle thereof, the load exerted upon shaft 30 by lost motion springs 24*a* and 24*b* maintains roller 26 in contact with center cam lobe 32*a*. As center cam lobe 32*a* returns to its zero lift profile, lost motion springs 24*a*, 24*b* bias shaft 30 upward within slots 56, 58 in the direction of camshaft 32 and into a position which enables the return of locking pin assembly 22 into the decoupled or lowlift first mode position.

It should be particularly noted that registration of pin orifices 50 and 52 relative to shaft bore 82 and pin chamber 84 is conjunctively accomplished by roller 26, bearings 28*b*, 28*b*, center cam lobe 32*a*, outer cam lobes 32*b*, 32*c*, and lost motion springs 24*a*, 24*b*. When center cam lobe 32*a* is at its base circle or lowest lift profile position, lost motion springs 24*a* and 24*b* bias shaft 30 toward camshaft 32, and maintain outer surface 26*a* of roller 26 engaged with center cam lobe 32*a*. The position of roller 26 and shaft 30 is located by the base circle of center cam lobe 32*a*, while the position of body 20 is located by the base circle of outer cam lobes 32*b*, and 32*c* engaging bearings 28*b*, 28*b*, respectively, such that shaft bore 82 and pin chamber 84 are axially aligned with pin orifices 50, 52. The axial alignment of shaft bore 82 and pin chamber 84 with pin orifices 50, 52 brings stem portion 74*a* of locking pin 74 into axial alignment with pin orifice 52 and head 74*b* into axial alignment with pin orifice 50 having button 76 disposed therein. Pin spring 78 then displaces locking pin 74 in a direction toward first side member 38. Pin spring 78 continues to displace locking pin 74 in a direction toward first side member 38 such that head 74*b* of locking pin 74 engages and displaces button 76. Thus, button 76 is displaced from disposition within pin chamber 84. The displacement of locking pin 74 and button 76 continues until shoulder 76*a* of locking pin 76 engages retaining clip 64.

In the firstlow-lift mode, two-step RFF 10 in conjunction with outside lobes 32*b*, 32*c* of camshaft 32 operate to activate valve 14 in accordance with the lift profile of outside lobes 32*b*, 32*c*. By configuring outside lobes 32*b*, 32*c* with, for example, a low and short duration lift profile, valve 14 is opened or lifted a predetermined and relatively slight amount for a relatively slight duration relative to the amount and duration of lift imparted to valve 14 with two-step RFF 10 in the second/high-lift mode. Thus, the quality of engine idle and low-speed/load driveability are improved by two-step RFF 10 operating in the first/low-lift mode, and by using two-step RFF 10 in conjunction with a camshaft which incorporates outside or low-lift cam lobes that provide a low and short duration lift profile by which valve 14 is actuated.

In the second/high-lift mode, two step RFF 10 in conjunction with center cam lobe 32*a* of camshaft 32 operate to activate valve 14 in accordance with the lift profile of center cam lobe 32*a*. By configuring center cam lobe 32*a* with, for example, a relatively high and long duration lift profile, valve 15 is opened or lifted a predetermined and relatively large amount for a relatively long duration relative to the amount and duration of lift imparted to valve 15 with two-step RFF 10 ni the first/low-lift mode. Thus, the breathing capability and the power capability of the engine under high-engine operating speed are improved.

The predetermined angular relationship of outer or low-lift cam lobes 32*b*, 32*c* and central or high-lift cam lobe 32*a* relative to each other and relative to central axis S of camshaft 32 is fixed such-that, for example, the maximum lift or peak of each cam lobe are at a predetermined angular position relative to central axis S. Thus, valve 14 is actuated at substantially the same time and at a predetermined angular position of camshaft 32, regardless of whether roller finger follower 10 is in the first/low-lift or second/high-lift mode. It is to be understood, however, that the angular position of one or both of outer or low-lift cam lobes 32*b*, 32*c* can be shifted or offset relative to central axis S and relative to center or high-lift cam lobe 32*a*. Offsetting the angular position of low-lift cam lobes 32*b*, 32*c* relative to central axis S and relative to high-lift cam lobe 32*a* changes the angular position of camshaft 32 at which valve 14 is opened with two-step RFF 10 in the second/high-lift mode relative to the angular position of camshaft 32 at which valve 14 is opened with roller finger follower 10 in the first/low-lift mode.

More particularly,,the angular position of outer or low-lift cam lobes 32*b*, 32*c* relative to central axis S can be offset, such as, for example, by positive (i.e., in the same direction as the rotation of camshaft 32) fifteen degrees relative to the angular position of center or high-lift cam lobe 32*a* to thereby phase the opening or actuation of valve 14. With cam lobes 32*a*, 32*b*, and 32*c* thus positioned, the peak of outer or low-lift cam lobes 32*b,* 32*c* rotationally precede the peak-of center or high-lift cam lobe 32*a* by fifteen degrees. With two-step RFF 10 in the first/low-lift mode, outer or low-lift cam lobes 32*b,* 32*c* engage bearings 28*b,* 28*b,* respectively, to thereby slightly open valve 14. Thus, the opening of valve 14 with two-step RFF 10 in the first/low-lift mode is changed or phased from the opening of valve 14 with two-step RFF 10 in the second/high-lift mode due to the advanced angular position of outer or low-lift cam lobes 32*b,* 32*c* relative to center or high-lift cam lobe 32*a*. Therefore, the opening or actuation of valve 14 can be changed and/or adjusted by selecting the predetermined angular relationship of outer/low-lift cam lobes 32*b,* 32*c* relative to center or high-lift cam lobe 32*a* to thereby change opening and closing timing of valve 14, as well as valve overlap, when two-step RFF 10 is in the first/low-lift mode. This control over valve lift, valve lift timing, valve opening duration and valve overlap can be used to optimize high speed power while maintaining low speed torque, driveability, and engine idle quality.

In the embodiment shown, the first/low-lift mode is the default position and the default operating mode of locking pin assembly 22 and two-step RFF 10, respectively. However, it is to be understood that two-step RFF 10 can be alternately configured, such as, for example, to have the second or high-lift mode as the default operating position/mode.

In the embodiment shown, bearings 28*b,* 28*b* are secured to body 20 of two-step RFF 10 to engage outside cam lobes 32*b,* 32*c* in a relatively frictionless manner. However, it is to be understood that two-step RFF 10 can be alternately configured, such as, for example, with slider pads disposed on or integral with the body thereof, to engage outside cam lobes 32*b,* 32*c*.

In the embodiment shown, retaining clips 64 and 66 are secured, such as, for example, by rolling, to a respective boss 46*a,* 46*b*. However, it is to be understood that two-step RFF 10 may be alternately configured, such as, for example, as having a retaining clip formed integrally with the boss or body, or attached by alternate means, such as, for example, staking or welding.

In the embodiment shown, each of slots 56 and 58 extend from the bottom surface (not referenced) of first and second side member 38, 40, respectively, to a top surface (not referenced) thereof. However, it is to be understood that the slots may be alternately configured, such as, for example, extending only partially toward one or both of the the top and bottom surfaces of the roller finger follower body.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A two-step roller finger follower for use with an internal combustion engine, said two-step roller finger follower comprising:

an elongate body having a first side member and a second side member, a first end and a second end interconnecting and spacing apart said first and second side member, said first and second side member defining a first and second pin orifice, respectively;

a center roller disposed between said first and second side member intermediate said first end and said second end of said body, said center roller defining a shaft orifice therethrough;

an elongate shaft extending through said shaft orifice, said shaft having a first shaft end and a second shaft end, said first shaft end being disposed proximate said first side member, said second shaft end being disposed proximate said second side member, said second shaft end defining a shaft bore therein, said first shaft end defining a pin chamber therein, said shaft bore being substantially concentric with and intersecting said pin chamber; and a locking pin assembly disposed partially within each of said shaft bore, said pin chamber and at least one of said pin orifices, said locking pin assembly having a first position wherein said shaft is decoupled from said body and a second position wherein said shaft is coupled to said body, said locking pin assembly being switchable between said first position and said second position.

2. The two-step roller finger follower of claim 1, further comprising:

a first bearing rotatably secured to said body; and a second bearing rotatably secured to said body.

3. The two-step roller finger follower of claim 2, wherein each of said first bearing and said second bearing are configured for engaging a respective outside cam lobe carried by a camshaft of the internal combustion engine.

4. The two-step roller finger follower of claim 2, wherein said first bearing and said second bearing are rotatably affixed to a respective one of said first side member and said second side member.

5. The two-step roller finger follower of claim 2, further comprising a first bearing boss disposed on said first side member, a second bearing boss disposed on said second side member, said first bearing being rotatably disposed upon said first bearing boss, said second bearing being rotatably disposed upon said second bearing boss.

6. The two-step roller finger follower of claim 5, further comprising a first retaining clip secured to said first bearing boss and being configured to retain said first bearing in disposition upon said first bearing boss, a second retaining clip secured to said second bearing boss and being configured to retain said second bearing in disposition upon said second bearing boss.

7. An internal combustion engine, comprising:

a camshaft; and a two-step roller finger follower, said two-step roller finger follower including:

an elongate body having a first side member and a second side member, a first end and a second end interconnecting and spacing apart said first and second side member, said first and second side member defining a first and second pin orifice, respectively;

a center roller disposed between said first and second side member intermediate said first end and said second end of said body, said roller defining a shaft orifice therethrough;

an elongate shaft extending through said shaft orifice, said shaft having a first shaft end and a second shaft end, said first shaft end being disposed proximate said first side member, said second shaft end being disposed proximate said second side member, said second shaft end defining a shaft bore therein, said first shaft end defining a pin chamber therein, said shaft bore being substantially concentric with and intersecting said pin chamber; and.

a locking pin assembly disposed partially within each of said shaft bore, said pin chamber and at least one of said pin orifices, said locking pin assembly having a first position wherein said shaft is decoupled from said body and a second position wherein said shaft is coupled to said body, said locking pin assembly being switchable between said first position and said second position.

8. The internal combustion engine of claim 7, further comprising:

a center cam lobe and at least one outside cam lobe carried by said camshaft, said center cam lobe engaging said center roller; and at least one bearing rotatably secured to said body, each of said at least one outside cam lobe engaging a respective one of said at least one bearing.

9. The internal combustion engine of claim 8, wherein said center cam lobe comprises a high-lift cam lobe, said at least one outside cam lobe comprises two low-lift cam lobes disposed on respective sides of and adjacent to said high-lift cam lobe, said at least one bearing comprises a first bearing and a second bearing, each of said first and said second bearings engaging a respective one of said two low-lift cam lobes.

10. The internal combustion engine of claim 9, wherein said low-lift cam lobe has at least one of a lower magnitude of lift and a shorter duration lift relative to said high-lift cam lobe.

11. The internal combustion engine of claim 8, wherein each of said at least one bearing is rotatably affixed to a respective one of said first side member and said second side member.

12. The internal combustion engine of claim 11, wherein said first side member and said second side member include a respective bearing boss, each of said at least one bearing being disposed on a corresponding bearing boss.

13. The internal combustion engine of claim 8, wherein said center cam lobe and said at least one outside cam lobe are disposed in a predetermined angular position relative to a central axis of said camshaft.

14. The internal combustion engine of claim 8, wherein said center cam lobe is disposed in a first angular position relative to a central axis of said camshaft, each of said at least one outside cam lobe being disposed in a second angular position relative to said central axis of said camshaft, said first angular position being different from said second angular position.

* * * * *